US010152937B2

(12) United States Patent
Abe et al.

(10) Patent No.: US 10,152,937 B2
(45) Date of Patent: Dec. 11, 2018

(54) SEMICONDUCTOR DEVICE, POWER SUPPLY CIRCUIT, AND LIQUID CRYSTAL DISPLAY DEVICE

(71) Applicant: SEIKO EPSON CORPORATION, Tokyo (JP)

(72) Inventors: Sachiyuki Abe, Hara-mura (JP); Nobuyuki Oikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/681,850

(22) Filed: Aug. 21, 2017

(65) Prior Publication Data

US 2018/0061342 A1 Mar. 1, 2018

(30) Foreign Application Priority Data

Aug. 24, 2016 (JP) ..... 2016-163443

(51) Int. Cl.
*G05F 1/573* (2006.01)
*G09G 3/36* (2006.01)

(52) U.S. Cl.
CPC ... *G09G 3/3648* (2013.01); *G09G 2310/0289* (2013.01); *G09G 2330/02* (2013.01); *G09G 2330/028* (2013.01)

(58) Field of Classification Search
CPC ..... G05F 1/573; G05F 1/56; G09G 3/038; G09G 5/00; H02M 3/07; H05B 33/0827; Y10S 362/80
USPC ..... 323/222, 224, 225, 267, 269, 271–274, 323/280, 312; 345/82, 99, 87, 100–104, 345/210–212
See application file for complete search history.

(56) References Cited

U.S. PATENT DOCUMENTS 5,896,387 A * 4/1999 Fujita ..... H04J 3/1611 370/220
6,236,194 B1 * 5/2001 Manabe ..... G05F 1/565 323/274
7,502,239 B2 * 3/2009 Itoh ..... H02M 3/07 327/536
7,791,580 B2 * 9/2010 Chung ..... G09G 3/3655 345/98
7,923,978 B2 * 4/2011 Kawashima ..... G05F 1/573 323/277
8,018,176 B1 * 9/2011 Small ..... H02M 3/156 315/291
8,125,431 B2 * 2/2012 Kimura ..... G09G 3/3696 345/212
8,305,371 B2 * 11/2012 Kim ..... G09G 3/3655 345/211

FOREIGN PATENT DOCUMENTS

JP 2002-291232 A 10/2002

* cited by examiner

*Primary Examiner* — Rajnikant Patel
(74) *Attorney, Agent, or Firm* — Oliff PLC

(57) ABSTRACT

This semiconductor device includes a first regulator that stabilizes an input voltage to generate a stabilized voltage; a voltage boosting circuit that boosts the stabilized voltage to generate a boosted voltage; a second regulator that stabilizes the boosted voltage to generate a first power supply voltage; and a third regulator that is connected to the second regulator in parallel, and that stabilizes the boosted voltage to generate a second power supply voltage.

12 Claims, 5 Drawing Sheets

SEMICONDUCTOR DEVICE, POWER SUPPLY CIRCUIT, AND LIQUID CRYSTAL DISPLAY DEVICE

This patent application claims the benefit of Japanese Patent Application No. 2016-163443, filed on Aug. 24, 2016. The content of the aforementioned application is incorporated herein by reference in its entirety.

BACKGROUND

1. Technical Field

The present invention relates to a semiconductor device and a power supply circuit that are used to boost an input voltage from a battery or the like to generate a desired power supply voltage. The invention also relates to a liquid crystal display device or the like that displays an image using a power supply voltage that is generated by such a semiconductor device or power supply circuit.

2. Related Art

For example, a liquid crystal display device requires a relatively high voltage to drive a liquid crystal panel. For this reason, in the case of portable devices such as a mobile phone or a mobile information terminal, a power supply voltage for displaying an image is generated by boosting an input voltage from a battery. For this purpose, for example, a plurality of external capacitors are attached to a semiconductor device that incorporates a voltage boosting circuit of the charge-pump type to constitute a power supply circuit. Typically, a liquid crystal display device requires a plurality of power supply voltages, and a power supply circuit is configured to generate a plurality of power supply voltages.

JP-A-2002-291232 discloses a related technique, namely a power supply circuit that generates a plurality of power supply voltages using a voltage boosting circuit of the charge-pump type. This power supply circuit includes a first voltage boosting circuit that boosts a first input voltage, a second voltage boosting circuit that receives a second input voltage that is an output voltage of the first voltage boosting circuit, a first regulator that smooths the output voltage of the first voltage boosting circuit, and a second regulator that smooths an output voltage of the second voltage boosting circuit.

However, in the power supply circuit in the JP-A-2002-291232, the first regulator smooths the output voltage of the first voltage boosting circuit to generate a first power supply voltage. For this reason, if a load current in the first regulator increases, there is a concern that the output voltage of the first voltage boosting circuit decreases. In this case, since the output voltage of the first voltage boosting circuit is further boosted by the second voltage boosting circuit, it is conceivable that the output voltage of the second voltage boosting circuit significantly decreases, affecting driving capability (capability to supply voltage or current) of the second regulator.

Moreover, a power supply circuit for a liquid crystal display device is required to meet various needs, such as expanding the available input voltage range, increasing voltage conversion efficiency, and adjustable output voltage. In particular, in the case where a memory liquid crystal panel is used in a liquid crystal display device, it is necessary to greatly reduce power consumption in a low power consumption mode in which the supply of image data to a liquid crystal driving circuit is stopped and a state is maintained where a fixed image is displayed on the liquid crystal panel, compared with the power consumption in a normal operation mode in which image data is continuously supplied to the liquid crystal driving circuit to display an image on the liquid crystal panel.

SUMMARY

In view of the foregoing points, a first advantage of the invention lies in a reduction in the influence of an increase in a load current on a voltage boosting operation, and an improved capability to drive a load as compared with the known techniques, in a semiconductor device or a power supply circuit that is used to boost an input voltage to generate a plurality of power supply voltages. A second advantage of the invention lies in expansion of the available input voltage range, an increase in the voltage conversion efficiency, adjustable output voltage, and selectable power consumption levels in such a semiconductor device or power supply circuit. A third advantage of the invention lies in provision of a liquid crystal display device or the like that displays an image using a power supply voltage generated by such a semiconductor device or power supply circuit.

A semiconductor device according to a first aspect of the invention includes: a first regulator that stabilizes an input voltage to generate a stabilized voltage; a voltage boosting circuit that boosts the stabilized voltage to generate a boosted voltage; a second regulator that stabilizes the boosted voltage to generate a first power supply voltage; and a third regulator that is connected to the second regulator in parallel, and that stabilizes the boosted voltage to generate a second power supply voltage.

According to the first aspect of the invention, the boosted voltage that has been boosted to a sufficiently high level by the voltage boosting circuit is stabilized by the second and third regulators that are connected in parallel. Thus, even if a load current has increased, it is possible to reduce the influence thereof on the voltage boosting operation, and improve the capability to drive the load compared with known techniques. In addition, the first regulator stabilizes the input voltage supplied from a battery or the like to generate the stabilized voltage, and thereafter the voltage boosting circuit boosts the stabilized voltage to generate the boosted voltage. Accordingly, the available input voltage range can be expanded.

Here, the voltage boosting circuit may include an N-channel transistor and five P-channel transistors that are connected in series, and boost the stabilized voltage substantially three times through a charge-pump operation to generate the boosted voltage when a plurality of capacitors are connected to six terminals that are connected, in one-to-one correspondence, to the N-channel transistor and the fixe P-channel transistors. With this configuration, a boosted voltage that is about three times the stabilized voltage supplied from the first regulator can be generated with a high voltage conversion efficiency.

The first regulator may include a differential amplifier circuit that operates upon receiving a supply of the input voltage, and amplifies a difference between a reference voltage and a feedback voltage to generate the stabilized voltage, a voltage divider circuit that divides the stabilized voltage to generate the feedback voltage, and a capability selection circuit that selects a load change response capability of the first regulator by changing a value of a bias current flowing through two transistors that constitute a differential pair in the differential amplifier circuit. With this configuration, load change response capability and the power consumption of the first regulator are selected in accordance with a load state or the like, and thus unnecessary power consumption can be reduced.

Furthermore, the second or third regulator may include a differential amplifier circuit that operates upon receiving a supply of the boosted voltage, and amplifies a difference between a reference voltage and a feedback voltage to generate the first or second power supply voltage, a voltage divider circuit that divides the first or second power supply voltage to generate the feedback voltage, and a capability selection circuit that selects a load change response capability of the second or third regulator by changing a value of a bias current flowing through two transistors that constitute a differential pair in the differential amplifier circuit. With this configuration, load change response capability and the power consumption of the second or third regulator are selected in accordance with a load state or the like, and thus unnecessary power consumption can be reduced.

Otherwise, the second or third regulator may include a differential amplifier circuit that operates upon receiving a supply of the boosted voltage, and amplifies a difference between a reference voltage and a feedback voltage to generate the first or second power supply voltage, a voltage divider circuit that divides the first or second power supply voltage to generate the feedback voltage, and a voltage adjusting circuit that adjusts the first or second power supply voltage by selecting a voltage division ratio for the voltage divider circuit. With this configuration, the first or second power supply voltage is adjusted in accordance with the temperature or the like, and thus a desired power supply voltage can be generated.

In the above configuration, the first regulator may be able to be set to one of a first state of generating a first voltage as the stabilized voltage and a second state of generating a second voltage that is higher than the first voltage as the stabilized voltage, and the voltage boosting circuit may be able to be set to one of a first state of boosting the stabilized voltage substantially three times and a second state of boosting the stabilized voltage substantially twice. With this configuration, in the case where the range of input voltage to be dealt with is not very wide, the first regulator and the voltage boosting circuit are set to the second state, and it is thus possible to improve the voltage conversion efficiency and reduce the number of parts.

This semiconductor device may further include a logic circuit that operates upon receiving a supply of the first or second power supply voltage generated by the second or third regulator. With this configuration, the logic circuit incorporated in the semiconductor device can be operated using the first or second power supply voltage supplied to the load.

A power supply circuit according to a second aspect of the invention includes any of the above-described semiconductor devices, and a plurality of capacitors that are connected to the semiconductor device. According to the second aspect of the invention, it is possible to provide a power supply circuit with an improved capability to drive the load as compared with known techniques, and with a wide available input voltage range.

A liquid crystal display device according to a third aspect of the invention includes any of the above-described semiconductor devices, a liquid crystal panel, and a liquid crystal driving circuit that operates upon receiving a supply of the first and second power supply voltages generated by the second and third regulators, and drives the liquid crystal panel to display an image. According to the third aspect of the invention, a sufficient power supply current can be supplied to the liquid crystal driving circuit by the semiconductor device with an improved capability to drive the load compared with known techniques.

Here, the liquid crystal panel may be a memory liquid crystal panel, and the semiconductor device may further include a control unit that sets a load change response capability of the first, second, and third regulators to a first level in a normal operation mode in which image data is continuously supplied to the liquid crystal driving circuit to display an image on the liquid crystal panel, and sets the load change response capability of the first, second, and third regulators to a second level that is lower than the first level in a low power consumption mode in which the supply of the image data to the liquid crystal driving circuit is stopped and a state is maintained where a fixed image is displayed on the liquid crystal display. With this configuration, power consumption of the first to third regulators can be reduced in the low power consumption mode in which power consumption in the liquid crystal driving circuit is small.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
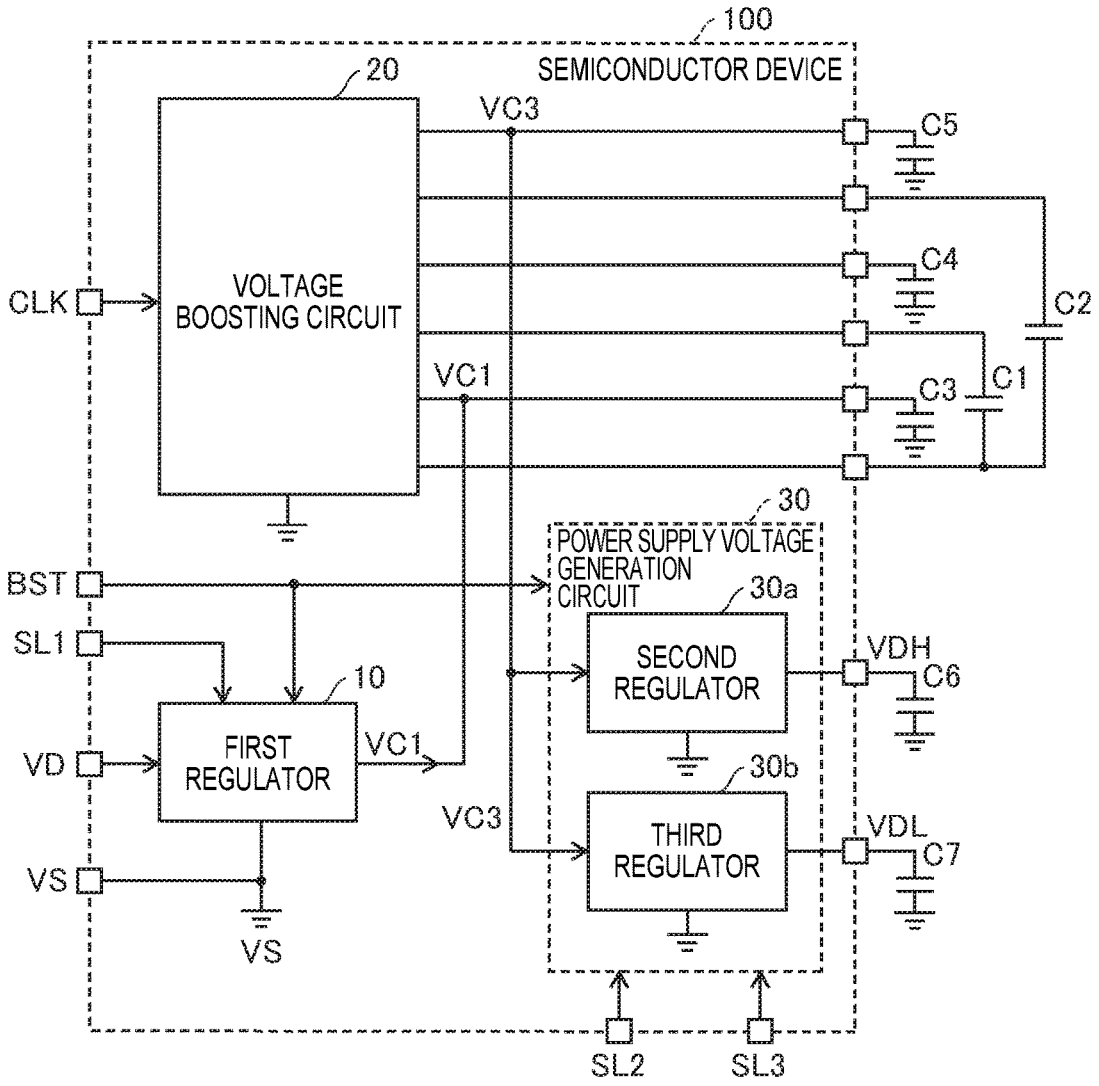
FIG. 1 is a block diagram showing an exemplary configuration of a power supply circuit according to an embodiment of the invention.

Hereinafter, an embodiment of the invention will be described in detail with reference to the drawings. Note that like constituent elements are assigned like reference numerals to omit redundant descriptions.

Power Supply Circuit

FIG. 1 is a block diagram showing an exemplary configuration of a power supply circuit according to an embodiment of the invention. As shown in FIG. 1, this power supply circuit includes a semiconductor device 100 according to an embodiment of the invention, and a plurality of external capacitors C1 to C7, which are connected to a plurality of terminals in the semiconductor device 100. The semiconductor device 100 includes a first regulator 10, a voltage boosting circuit 20, and a power supply voltage generation circuit 30. The power supply voltage generation circuit 30 includes a second regulator 30*a* and a third regulator 30*b*.

The first regulator 10 is connected to two input terminals, to which an input voltage (VD-VS) is supplied from a battery or the like. One of these input terminals is connected to a reference potential VS interconnect in the semiconductor device 100. In the following description, it is assumed that the reference potential VS is a ground potential of 0 V, and the input voltage (VD-VS) is equal to a positive input potential VD.

The first regulator 10 stabilizes the input voltage VD to generate a stabilized voltage VC1. The voltage boosting circuit 20 boosts the stabilized voltage VC1 to generate a boosted voltage VC3. The second regulator 30*a* stabilizes the boosted voltage VC3 to generate a first power supply voltage VDH. The third regulator 30*b* is connected to the second regulator 30*a* in parallel, and stabilizes the boosted voltage VC3 to generate a second power supply voltage VDL.

For example, the input voltage VD is in the range from 1.8 V to 5.5 V. The stabilized voltage VC1 is about 1.8 V. The voltage boosting circuit 20 boosts the stabilized voltage VC1 about three times to generate the boosted voltage VC3, which is about 5.4 V. The first power supply voltage VDH is about 5 V. The second power supply voltage VDL is about 3 V.

Thus, the boosted voltage VC3 that has been boosted to a sufficiently high voltage by the voltage boosting circuit 20 is stabilized by the second regulator 30*a* and the third regulator 30*b* that are connected in parallel. As a result, even if a load current has increased, it is possible to reduce the influence thereof on the voltage boosting operation and improve the capability to drive the load, compared with known techniques.

Since the voltage boosting circuit 20 boosts the stabilized voltage VC1 to generate the boosted voltage VC3 after the first regulator 10 has stabilized the input voltage VD supplied from a battery or the like to generate the stabilized voltage VC1, the available range of the input voltage VD can be expanded. Accordingly, it is possible to provide a power supply circuit with an improved capability to drive a load, compared with known techniques, and with a wide available range of the input voltage VD.

First Regulator

Figure 2:
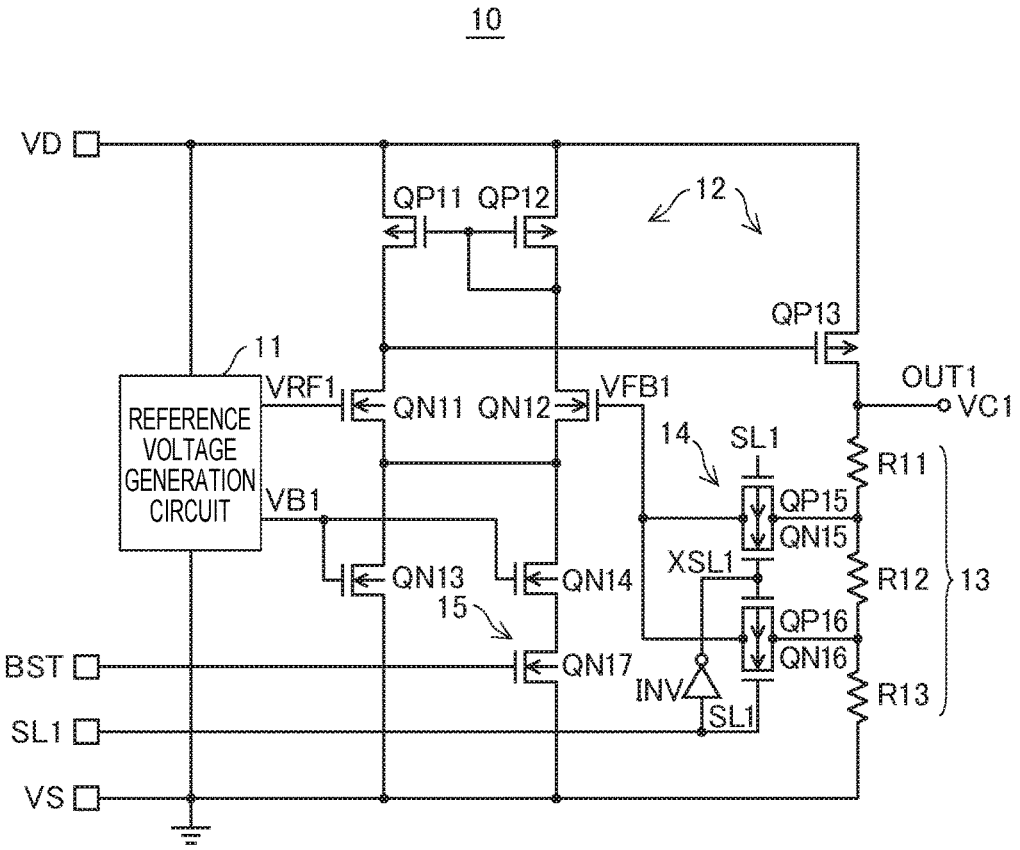
FIG. 2 is a circuit diagram showing an exemplary configuration of a first regulator shown in FIG. 1.

FIG. 2 is a circuit diagram showing an exemplary configuration of the first regulator shown in FIG. 1. The first regulator 10 includes a reference voltage generation circuit 11, a differential amplifier circuit 12, a voltage divider circuit 13, a voltage adjusting circuit 14, and a capability selection circuit 15.

The reference voltage generation circuit 11 operates upon receiving a supply of the input voltage VD, and generates a reference voltage VRF1 and a bias voltage VB1. The differential amplifier circuit 12 operates upon receiving a supply of the input voltage VD, and amplifies a difference between the reference voltage VRF1 and a feedback voltage VFB1 to generate the stabilized voltage VC1. The voltage divider circuit 13 divides the stabilized voltage VC1 to generate the feedback voltage VFB1. The voltage adjusting circuit 14 selects a voltage division ratio for the voltage divider circuit 13, thereby adjusting the stabilized voltage VC1. The capability selection circuit 15 selects a load change response capability for the first regulator 10.

In the example shown in FIG. 2, the differential amplifier circuit 12 includes P-channel MOS transistors QP11 to QP13 and N-channel MOS transistors QN11 to QN14. The transistors QP11 and QP12 each have a source that is connected to the input potential VD interconnect, and a gate that is connected to a drain of the transistor QP12, and constitute a current mirror circuit.

The transistors QN11 and QN12 have drains that are connected to drains of the transistors QP11 and QP12, respectively, and sources that are connected to each other, and constitute a differential pair in the differential amplifier circuit 12. The reference voltage VRF1 is applied to a gate of the transistor QN11. The feedback voltage VFB1 is applied to a gate of the transistor QN12.

The transistors QN13 and QN14 have drains that are connected to the sources of the transistors QN11 and QN12, respectively, and gates to which the bias voltage VB1 is applied. A source of the transistor QN13 is connected to a reference potential VS interconnect. The transistor QN13 supplies the bias current to the two transistors QN11 and QN12 that constitute the differential pair.

The transistor QP13 has a source that is connected to the input potential VD interconnect, a gate that is connected to the drain of the transistor QP11 and the drain of the transistor QN11, and a drain that is connected to an output terminal OUT1 of the first regulator 10, and constitutes an output stage of the differential amplifier circuit 12. The differential amplifier circuit 12 generates the stabilized voltage VC1 so that the feedback voltage VFB1 is substantially equal to the reference voltage VRF1, and supplies the generated stabilized voltage VC1 to the output terminal OUT1.

The voltage divider circuit 13 includes resistors R11 to R13, which are connected in series between the output terminal OUT1 and the reference potential VS interconnect. The voltage adjusting circuit 14 includes P-channel MOS transistors QP15 and QP16, N-channel MOS transistors QN15 and QN16, and an inverter INV. The inverter INV inverts a selection signal SL1 for selecting a value of the stabilized voltage VC1, and generates an inverted selection signal XSL1.

The transistors QP15 and QN15 constitute a first analog switch, which turns on in a first state where the selection signal SL1 is inactivated to a low level, and connects a node between the resistor R11 and resistor R12 to the gate of the transistor QN12. Thus, the feedback voltage VFB1 that is generated as a result of the stabilized voltage VC1 being divided by the resistor R11 and the resistors R12 and R13 is applied to the gate of the transistor QN12. In the first state, the first regulator 10 generates a stabilized voltage VC1 of about 1.8 V, for example.

The transistors QP16 and QN16 constitute a second analog switch, which turns on in a second state where the selection signal SL1 is activated to a high level, and connects a node between the resistor R12 and resistor R13 to the gate of the transistor QN12. Thus, the feedback voltage VFB1 that is generated as a result of the stabilized voltage VC1 being divided by the resistors R11 and R12 and the resistor R13 is applied to the gate of the transistor QN12. In the second state, the first regulator 10 generates a stabilized voltage VC1 of about 2.7 V, for example.

The transistor QN17 in the capability selection circuit 15 has a drain that is connected to the source of the transistor QN14, a source that is connected to the reference potential VS interconnect, and a gate to which a selection signal BST for selecting the load change response capability is applied. The transistor QN17 turns on in a normal operation mode in which the selection signal BST is activated to a high level, and connects the source of the transistor QN14 to the reference potential VS interconnect. As a result, the bias current flowing through the two transistors QN11 and QN12 that constitute the differential pair increases, and the load change response capability (slew rate, open-loop amplification factor etc.) of the first regulator 10 is set to a first level.

On the other hand, the transistor QN17 turns off in a low power consumption mode in which the selection signal BST is inactivated to a low level. As a result, the bias current flowing through the two transistors QN11 and QN12 that constitute the differential pair decreases, and the load change response capability of the first regulator 10 is set to a second level, which is lower than the first level. The power consumption also decreases accordingly.

Thus, the capability selection circuit 15 selects the load change response capability of the first regulator 10 by changing the value of the bias current flowing through the two transistors QN11 and QN12 that constitute the differential pair in the differential amplifier circuit 12. With this configuration, the load change response capability and the power consumption of the first regulator 10 are selected in accordance with a load state or the like, and thus unnecessary power consumption can be reduced.

Voltage Boosting Circuit

Figure 3:
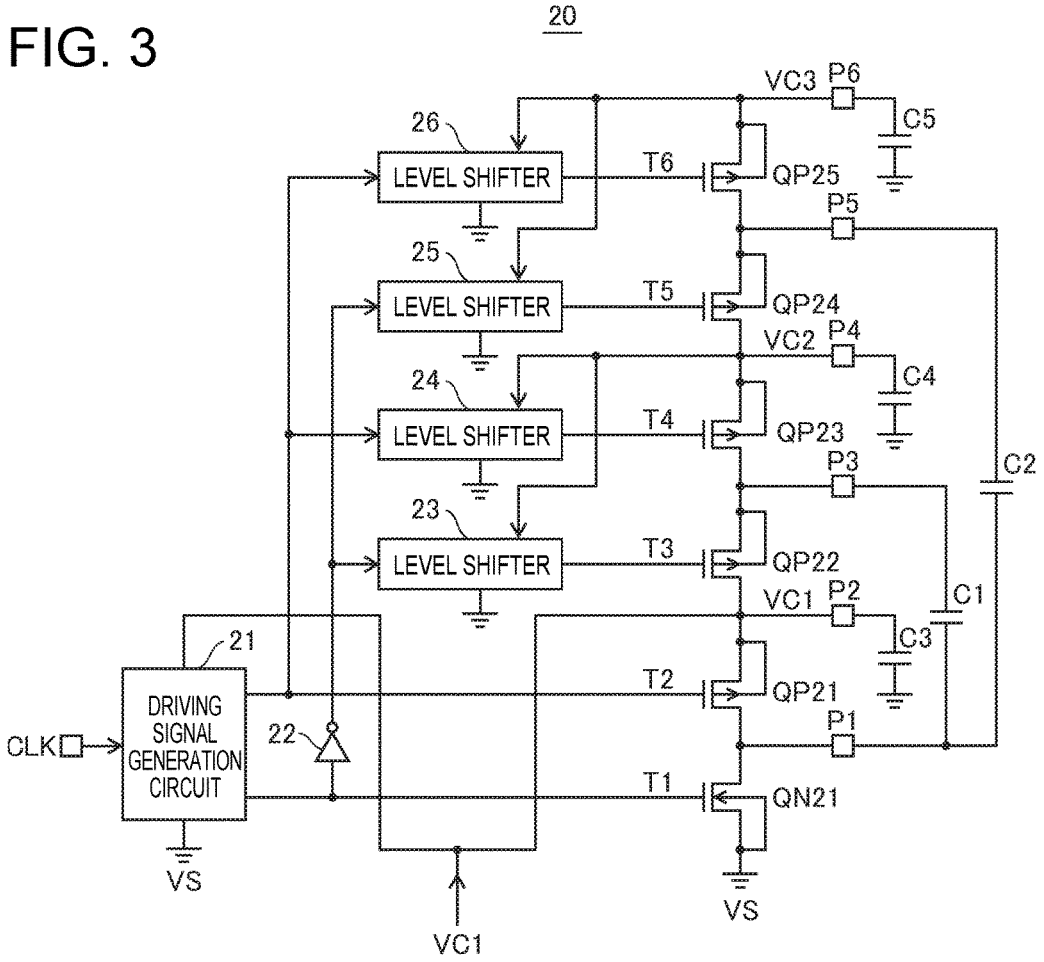
FIG. 3 is a circuit diagram showing an exemplary configuration of a voltage boosting circuit shown in FIG. 1.
Figure 4:
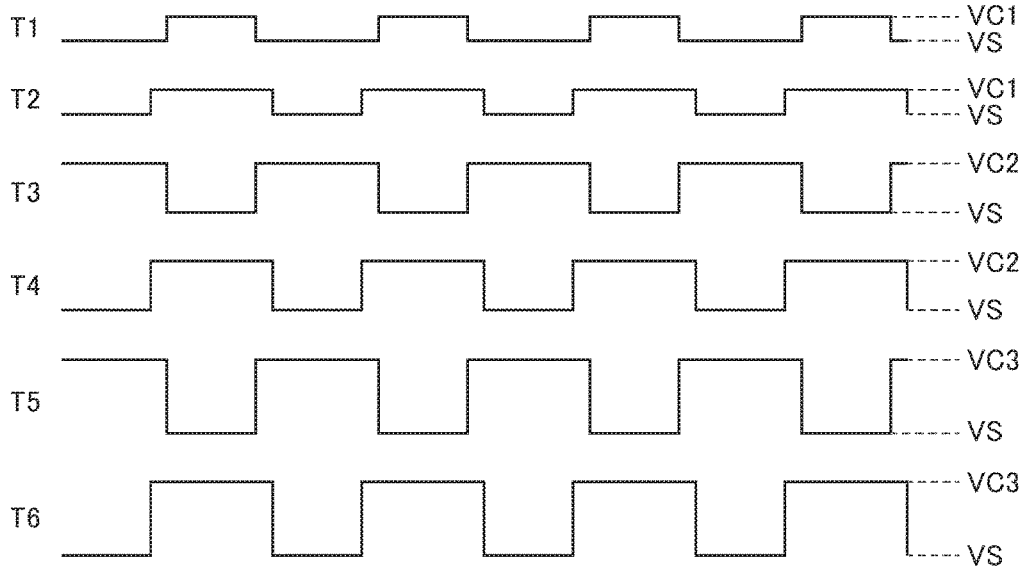
FIG. 4 is a diagram showing waveforms of driving signals used in the voltage boosting circuit shown in FIG. 3.

FIG. 3 is a circuit diagram showing an exemplary configuration of the voltage boosting circuit shown in FIG. 1. FIG. 4 is a diagram showing waveforms of driving signals used in the voltage boosting circuit shown in FIG. 3. In the example shown in FIG. 3, the voltage boosting circuit 20 includes a driving signal generation circuit 21, an inverter 22, level shifters 23 to 26, and an N-channel MOS transistor QN21 and five P-channel MOS transistors QP21 to QP25, which are connected in series.

The voltage boosting circuit 20 performs a voltage boosting operation through a charge-pump operation when the plurality of capacitors C1 to C5 are connected to six terminals (pads) P1 to P6, which are connected respectively to the transistor QN21 and transistors QP21 to QP25. As a result, the voltage boosting circuit 20 boosts, about three times, the stabilized voltage VC1 supplied from the first regulator 10 shown in FIG. 2 to generate the boosted voltage VC3.

The driving signal generation circuit 21 operates upon receiving a supply of the stabilized voltage VC1, and generates driving signals T1 and T2 having waveforms shown in FIG. 4, based on a clock signal CLK. The clock signal CLK has a frequency of about 32 kHz, for example. The driving signals T1 and T2 shift between a stabilized potential VC1 and the reference potential VS.

The driving signal T1 is supplied to a gate of the transistor QN21 and an input terminal of the inverter 22. The inverter 22 inverts the driving signal T1, and outputs the inverted driving signal T1 to the level shifters 23 and 25. The driving signal T2 is supplied to a gate of the transistor QP21 and the level shifters 24 and 26.

The level shifters 23 to 26 are each constituted by a plurality of P-channel MOS transistors and a plurality of N-channel MOS transistors, for example. The level shifter 23 operates upon receiving a supply of the boosted voltage VC2, generates a driving signal T3 having a waveform shown in FIG. 4 by shifting the high level of the inverted driving signal T1, and supplies the generated driving signal T3 to a gate of the transistor QP22. The level shifter 24 operates upon receiving a supply of the boosted voltage VC2, generates a driving signal T4 having a waveform shown in FIG. 4 by shifting the high level of the driving signal T2, and supplies the generated driving signal T4 to a gate of the transistor QP23. The driving signals T3 and T4 shift between a boosted potential VC2 and the reference potential VS.

The level shifter 25 operates upon receiving a supply of the boosted voltage VC3, generates a driving signal T5 having a waveform shown in FIG. 4 by shifting the high level of the inverted driving signal T1, and supplies the generated driving signal T5 to a gate of the transistor QP24. The level shifter 26 operates upon receiving a supply of the boosted voltage VC3, generates a driving signal T6 having a waveform shown in FIG. 4 by shifting the high level of the driving signal T2, and supplies the generated driving signal T6 to a gate of the transistor QP25. The driving signals T5 and T6 shift between a boosted potential VC3 and the reference potential VS.

The capacitor C1, which serves as a flying capacitor, is connected between the terminal P1 and terminal P3. The capacitor C2, which also serves as a flying capacitor, is connected between the terminal P1 and terminal P5. The capacitor C3, which serves as a smoothing capacitor, is connected between the terminal P2 and a reference potential VS interconnect. The capacitor C4, which also serves as a smoothing capacitor, is connected between the terminal P4 and a reference potential VS interconnect. The capacitor C5, which also serves as a smoothing capacitor, is connected between the terminal P6 and a reference potential VS interconnect.

The transistors QN21 and QP21 to QP25 perform a switching operation in accordance with the respective driving signals T1 to T6, respectively, thereby repeating charging and discharging of the capacitors C1 and C2. Electrical charges accordingly move, and a charge-pump operation is performed. As a result, the boosted potential VC2 at the terminal P4 gradually rises and reaches about twice the stabilized potential VC1, in a stationary state. The boosted potential VC3 at the terminal P6 also gradually rises and reaches about three times the stabilized potential VC1 in a stationary state. With this configuration, the boosted voltage VC3 that is about three times the stabilized voltage VC1 supplied from the first regulator 10 shown in FIG. 2 can be generated with a high voltage conversion efficiency.

The first regulator 10 can be set, using the selection signal SL1, to one of a first state of generating a first voltage (e.g. about 1.8 V) as the stabilized voltage VC1 and a second state of generating a second voltage (e.g. about 2.7 V), which is higher than the first voltage, as the stabilized voltage VC1. The voltage boosting circuit 20 can be set, based on the connection state of the terminals P1 to P6, to one of a first state of boosting the stabilized voltage VC1 about three times and a second state of boosting the stabilized voltage VC1 about twice.

For example, if the capacitor C1 is connected between the terminal P1 and terminal P3, while the capacitor C2 is not connected between the terminal P1 and terminal P5, the voltage boosting circuit 20 boosts the stabilized voltage VC1 about twice to generate the boosted voltage VC2, but does not boost it three times. Furthermore, the capacitor C5 does not need to be connected between the terminal P6 and the reference potential VS interconnect. The terminal P6 may be short-circuited to the reference potential VS interconnect to stop the operations of the level shifters 25 and 26.

Accordingly, if the range of the input voltage VD to be dealt with is not very wide, the first regulator 10 and the voltage boosting circuit 20 are set to the second state, and it is thus possible to improve the voltage conversion efficiency and reduce the number of parts. In this case, the connection state is changed so as to supply the boosted voltage VC2 (e.g. about 5.4 V) generated by the voltage boosting circuit 20 to the power supply voltage generation circuit 30 (FIG. 1).

Power Supply Voltage Generation Circuit

Figure 5:
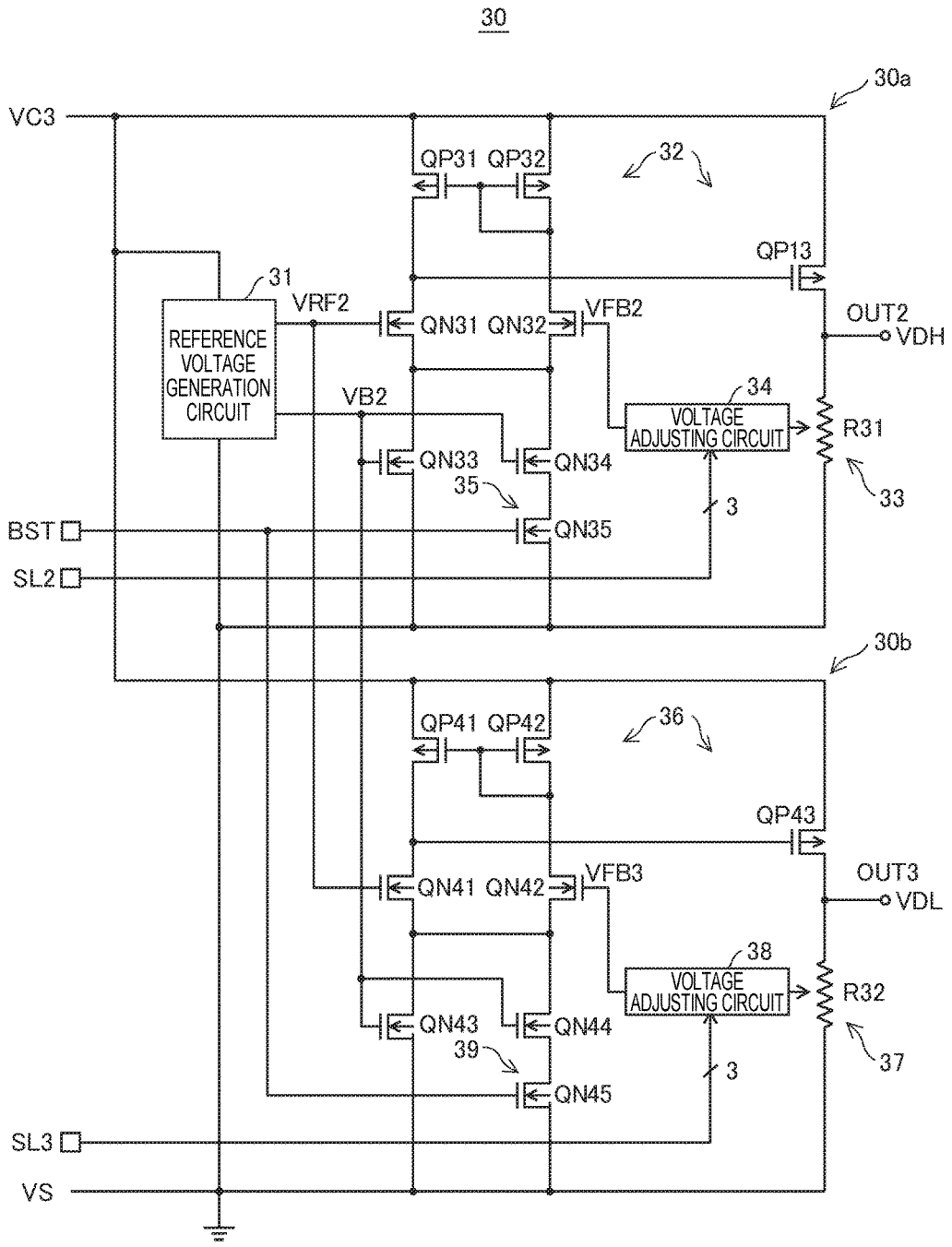
FIG. 5 is a circuit diagram showing an exemplary configuration of a power supply voltage generation circuit shown in FIG. 1.

FIG. 5 is a circuit diagram showing an exemplary configuration of the power supply voltage generation circuit shown in FIG. 1. The power supply voltage generation circuit 30 includes the second regulator 30*a* that stabilizes the boosted voltage VC3 to generate the first power supply voltage VDH, and the third regulator 30*b* that stabilizes the boosted voltage VC3 to generate the second power supply voltage VDL. The second regulator 30*a* and third regulator 30*b* are connected in parallel, and share the reference voltage generation circuit 31. The reference voltage generation circuit 31 operates upon receiving a supply of the boosted voltage VC3, and generates the reference voltage VRF2 and the bias voltage VB2.

Second Regulator

The second regulator 30*a* includes a differential amplifier circuit 32, a voltage divider circuit 33, a voltage adjusting circuit 34, and a capability selection circuit 35. The differential amplifier circuit 32 operates upon receiving a supply of the boosted voltage VC3, and amplifies a difference between the reference voltage VRF2 and a feedback voltage VFB2 to generate the first power supply voltage VDH. The voltage divider circuit 33 divides the first power supply voltage VDH to generate the feedback voltage VFB2. The voltage adjusting circuit 34 selects a voltage division ratio for the voltage divider circuit 33, thereby adjusting the first power supply voltage VDH. The capability selection circuit 35 selects a load change response capability of the second regulator 30*a*.

In the example shown in FIG. 5, the differential amplifier circuit 32 includes P-channel MOS transistors QP31 to QP33 and N-channel MOS transistors QN31 to QN34. The transistors QP31 and QP32 each have a source that is connected to a boosted potential VC3 interconnect, and a gate that is connected to a drain of the transistor QP32, and constitute a current mirror circuit.

The transistors QN31 and QN32 have drains that are connected to drains of the transistors QP31 and QP32, respectively, and sources that are connected to each other, and constitute a differential pair in the differential amplifier circuit 32. The reference voltage VRF2 is applied to a gate of the transistor QN31. The feedback voltage VFB2 is applied to a gate of the transistor QN32.

The transistors QN33 and QN34 have drains that are connected to the sources of the transistors QN31 and QN32, respectively, and gates to which a bias voltage VB2 is applied. A source of the transistor QN33 is connected to a reference potential VS interconnect. The transistor QN33 supplies a bias current to the two transistors QN31 and QN32 that constitute the differential pair.

The transistor QP33 has a source that is connected to a boosted potential VC3 interconnect, and a gate that is connected to the drain of the transistor QP31 and the drain of the transistor QN31, and a drain that is connected to an output terminal OUT2 of the second regulator 30*a*, and constitutes an output stage of the differential amplifier circuit 32. The differential amplifier circuit 32 generates the first power supply voltage VDH so that the feedback voltage VFB2 is substantially equal to the reference voltage VRF2, and supplies the generated first power supply voltage VDH to the output terminal OUT2.

The voltage divider circuit 33 includes a ladder resistor R31, which is constituted by a plurality of resistors that are connected in series between the output terminal OUT2 and a reference potential VS interconnect. The voltage adjusting circuit 34 includes a selector for selecting one terminal from among terminals of the plurality of resistors that constitute the ladder resistor R31 to connect to the gate of the transistor QN32, in accordance with a selection signal SL2 for selecting a value of the first power supply voltage VDH. Thus, the feedback voltage VFB2, which is generated due to the first power supply voltage VDH being divided by the ladder resistor R31, is applied to the gate of the transistor QN32.

The selector of the voltage adjusting circuit 34 includes eight analog switches, for example. The selector selects one terminal from among eight terminals of the ladder resistor R31 to connect to the gate of the transistor QN32, in accordance with a 3-bit selection signal SL2. For example, the first power supply voltage VDH is adjusted within a range from about 4.4 V to about 5.05 V. Thus, the first power supply voltage VDH is adjusted in accordance with the temperature or the like, and a desired power supply voltage can be generated.

The transistor QN35 in the capability selection circuit 35 has a drain that is connected to the source of the transistor QN34, a source that is connected to a reference potential VS interconnect, and a gate to which the selection signal BST for selecting the load change response capability is applied. The transistor QN35 turns on in the normal operation mode in which the selection signal BST is activated to a high level, and connects the source of the transistor QN34 to the reference potential VS interconnect. As a result, a bias current flowing through the two transistors QN31 and QN32 that constitute the differential pair increases, and the load change response capability of the second regulator 30*a* is set to a first level.

On the other hand, the transistor QN35 turns off in the low power consumption mode in which the selection signal BST is inactivated to a low level. As a result, the bias current flowing through the two transistors QN31 and QN32 that constitute the differential pair decreases, and the load change response capability of the second regulator 30*a* is set to a second level, which is lower than the first level. The power consumption also decreases accordingly. With this configuration, the load change response capability and the power consumption of the second regulator 30*a* are selected in accordance with a load state or the like, and thus unnecessary power consumption can be reduced.

Third Regulator

The third regulator 30*b* includes a differential amplifier circuit 36, a voltage divider circuit 37, a voltage adjusting circuit 38, and a capability selection circuit 39. The differential amplifier circuit 36 operates upon receiving a supply of the boosted voltage VC3, and amplifies a difference between the reference voltage VRF2 and a feedback voltage VFB3 to generate the second power supply voltage VDL. The voltage divider circuit 37 divides the second power supply voltage VDL to generate the feedback voltage VFB3. The voltage adjusting circuit 38 selects a voltage division ratio for the voltage divider circuit 37, thereby adjusting the second power supply voltage VDL. The capability selection circuit 39 selects a load change response capability of the third regulator 30*b*.

In the example shown in FIG. 5, the differential amplifier circuit 36 includes P-channel MOS transistors QP41 to QP43, and N-channel MOS transistors QN41 to QN44. The transistors QP41 and QP42 each have a source that is connected to a boosted potential VC3 interconnect, and a gate that is connected to a drain of the transistor QP42, and constitute a current mirror circuit.

The transistors QN41 and QN42 have drains that are connected to drains of the transistors QP41 and QP42, respectively, and sources that are connected to each other, and constitute a differential pair in the differential amplifier circuit 36. The reference voltage VRF2 is applied to a gate of the transistor QN41. The feedback voltage VFB3 is applied to a gate of the transistor QN42.

The transistors QN43 and QN44 have drains that are connected to the sources of the transistors QN41 and QN42, respectively, and gates to which the bias voltage VB2 is applied. A source of the transistor QN43 is connected to a reference potential VS interconnect. The transistor QN43 supplies a bias current to the two transistors QN41 and QN42 that constitute the differential pair.

The transistor QP43 has a source that is connected to a boosted potential VC3 interconnect, and a gate that is connected to the drain of the transistor QP41 and the drain of the transistor QN41, and a drain that is connected to an output terminal OUT3 of the third regulator 30*b*, and constitutes an output stage of the differential amplifier circuit 36. The differential amplifier circuit 36 generates the second power supply voltage VDL so that the feedback voltage VFB3 is substantially equal to the reference voltage VRF2, and supplies the generated second power supply voltage VDL to the output terminal OUT3.

The voltage divider circuit 37 includes a ladder resistor R32, which is constituted by a plurality of resistors that are connected in series between the output terminal OUT3 and a reference potential VS interconnect. The voltage adjusting circuit 38 also includes a selector for selecting one terminal from among terminals of the plurality of resistors that constitute the ladder resistor R32 to connect to the gate of the transistor QN42, in accordance with a selection signal SL3 for selecting a value of the second power supply voltage VDL. Thus, the feedback voltage VFB3, which is generated due to the second power supply voltage VDL being divided by the ladder resistor R32, is applied to the gate of the transistor QN42.

The selector of the voltage adjusting circuit 38 is constituted by eight analog switches, for example. The selector selects one terminal from among eight terminals of the ladder resistor R32 to connect to the gate of the transistor QN42, in accordance with a 3-bit selection signal SL3. For example, the second power supply voltage VDL is adjusted within a range from about 2.7 V to about 3.4 V. Thus, the second power supply voltage VDL is adjusted in accordance with the temperature or the like, and a desired power supply voltage can be generated.

The transistor QN45 in the capability selection circuit 39 has a drain that is connected to the source of the transistor QN44, a source that is connected to a reference potential VS interconnect, and a gate to which the selection signal BST for selecting the load change response capability is applied. The transistor QN45 turns on in the normal operation mode in which the selection signal BST is activated to a high level, and connects the source of the transistor QN44 to the reference potential VS interconnect. As a result, the bias current flowing through the two transistors QN41 and QN42 that constitute the differential pair increases, and the load change response capability of the third regulator 30*b* is set to a first level.

On the other hand, the transistor QN45 turns off in the low power consumption mode in which the selection signal BST is inactivated to a low level. As a result, the bias current flowing through the two transistors QN41 and QN42 that constitute the differential pair decreases, and the load change response capability of the third regulator 30*b* is set to a second level that is lower than the first level. The power consumption also decreases accordingly. Thus, the load change response capability and the power consumption of the third regulator 30*b* are selected in accordance with a load state or the like, and thus unnecessary power consumption can be reduced.

Liquid-Crystal Display Device

Figure 6:
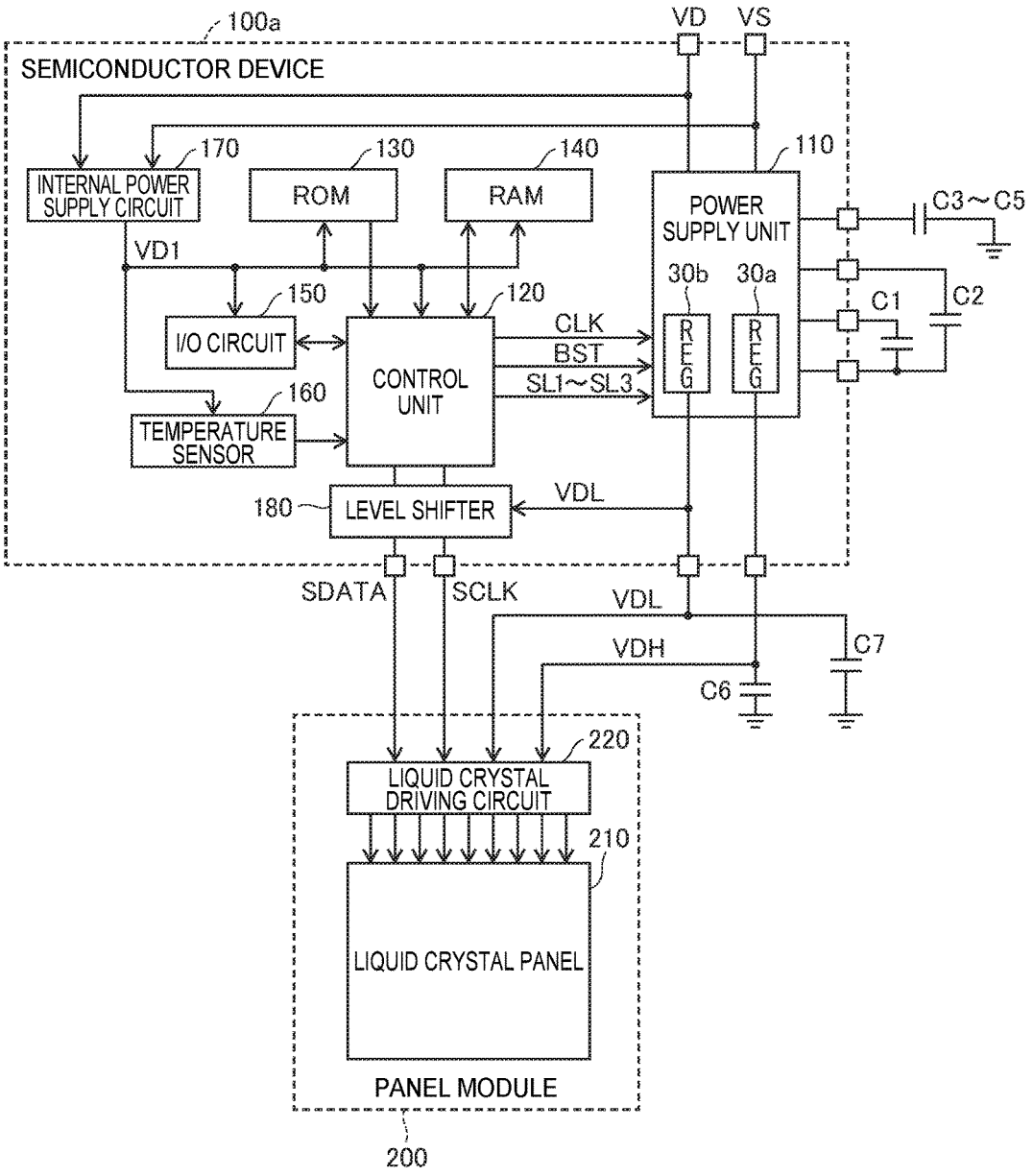
FIG. 6 is a block diagram showing an exemplary configuration of a liquid crystal display device according to an embodiment of the invention.

FIG. 6 is a block diagram showing an exemplary configuration of a liquid crystal display device according to an embodiment of the invention. As shown in FIG. 6, this liquid crystal display device includes, for example, a semiconductor device 100*a*, which serves as a microcomputer, a plurality of external capacitors C1 to C7, which are connected to a plurality of terminals in the semiconductor device 100*a*, and a panel module 200, which is constituted by a liquid crystal panel 210 and a liquid crystal driving circuit 220.

The semiconductor device 100*a* includes a power supply unit 110, a control unit 120, a ROM (read only memory) 130, a RAM (random access memory) 140, an I/O circuit 150, a temperature sensor 160, an internal power supply circuit 170, and a level shifter 180. The ROM 130 may be a nonvolatile memory such as a flash memory. Note that some of the constituent elements shown in FIG. 6 may be omitted or modified. Otherwise, other constituent elements may be added to the constituent elements shown in FIG. 6.

The power supply unit 110 has the same circuitry as the circuitry of the semiconductor device 100 shown in FIG. 1, and operates upon receiving a supply of the input voltage (VD-VS). In the power supply unit 110, the second regulator 30*a* generates the first power supply voltage VDH, and the third regulator 30*b* generates the second power supply voltage VDL. The first power supply voltage VDH and second power supply voltage VDL are supplied to the panel module 200, which serves as a load.

The control unit 120 includes a CPU (central processing unit), for example, and performs various kinds of signal processing and control processing using image data or the like that is supplied from the outside, in accordance with programs stored in the ROM 130. For example, the control unit 120 generates serial image data SDATA for displaying various images on the panel module 200, and outputs the generated serial image data SDATA together with a serial clock signal SCLK to the level shifter 180.

The level shifter 180 is, for example, a logic circuit that is constituted by a plurality of P-channel MOS transistors and a plurality of N-channel MOS transistors. For example, the level shifter 180 receives a supply of the second power supply voltage VDL from the power supply unit 110, and shifts the high level of the serial image data SDATA and serial clock signal SCLK to the high potential side of the second power supply voltage VDL. The serial image data SDATA and serial clock signal SCLK output from the level shifter 180 are supplied to the panel module 200. Thus, the logic circuit incorporated in the semiconductor device 100*a* can be operated using the second power supply voltage VDL (or first power supply voltage VDH) supplied to the load.

Programs, data, and the like with which the control unit 120 performs various kinds of signal processing and control processing are stored in the ROM 130. The RAM 140 is used as a work area for the control unit 120, and temporarily stores programs and data that are read out from the ROM 130, the result of calculations executed by the control unit 120 in accordance with the programs, or the like.

The I/O circuit 150 is constituted by a digital circuit and an analog circuit, for example, and performs I/O access operations with an external device that is connected to the semiconductor device 100*a*. The temperature sensor 160 detects the temperature in and around the semiconductor device 100*a* to generate an output voltage, and outputs the generated output voltage to the control unit 120.

The internal power supply circuit 170 includes a regulator, for example, and generates a stabilized internal power supply voltage VD1 (e.g. 1.5 V) based on the input voltage (VD-VS). The control unit 120, ROM 130, RAM 140, I/O circuit 150, and temperature sensor 160 operate upon receiving a supply of the internal power supply voltage VD1.

In the panel module 200, the liquid crystal driving circuit 220 operates upon receiving a supply of the first power supply voltage VDH and second power supply voltage VDL that are generated respectively by the second regulator 30*a* and third regulator 30*b* in the semiconductor device 100*a*. The liquid crystal driving circuit 220 drives the liquid crystal panel 210 to display an image.

For example, the first power supply voltage VDH is supplied to a driving signal generation circuit that generates a driving signal for driving the liquid crystal panel 210. The second power supply voltage VDL is supplied to a signal processing circuit that performs signal processing in the liquid crystal driving circuit 220. According to this embodiment, a sufficient power supply current can be supplied to the liquid crystal driving circuit 220 by the semiconductor device 100*a* with an improved capability to drive the load compared with known techniques.

A plurality of values of the selection signal SL2 and a plurality of values of the selection signal SL3 are stored corresponding to a plurality of temperature ranges, in the ROM 130 in the semiconductor device 100*a*. The control unit 120 reads out, from the ROM 130, the values of the selection signals SL2 and SL3 that correspond to the temperature range, which is specified by the output voltage of the temperature sensor 160, and outputs the selection signals SL2 and SL3 representing these values to the voltage adjusting circuits 34 and 38 shown in FIG. 5. Thus, the first power supply voltage VDH and second power supply voltage VDL are compensated in accordance with the temperature.

Otherwise, a configuration may also be employed in which a person who is watching an image displayed on the liquid crystal panel 210 transmits, to the I/O circuit 150, an instruction to change the image quality, such as brightness, using a remote controller or the like, and the control unit 120 then changes the selection signals SL2 and SL3 in accordance with the instruction received by the I/O circuit 150. The control unit 120 may also change the voltage boosting efficiency in the voltage boosting circuit 20 (FIG. 2) by selecting the frequency of the clock signal CLK to be supplied to the power supply unit 110, and adjust the first power supply voltage VDH and second power supply voltage VDL.

Here, the liquid crystal panel 210 may be a memory liquid crystal panel. Pixels in the memory liquid crystal panel are bistable, namely are stable in both a translucent state and a non-translucent state. The memory liquid crystal panel requires electric power at the moment of writing an image signal for displaying an image on the liquid crystal panel, but does not require electric power at other times.

Accordingly, it is possible to greatly reduce power consumption in the low power consumption mode in which a supply of the serial image data SDATA to the liquid crystal driving circuit 220 is stopped and a state is maintained where a fixed image is displayed on the liquid crystal panel 210, compared with the power consumption in the normal operation mode in which the serial image data SDATA is continuously supplied to the liquid crystal driving circuit 220 to display an image on the liquid crystal panel 210. Power consumption in the semiconductor device 100*a* in the low power consumption mode also needs to be reduced accordingly.

For this reason, the control unit 120 activates the selection signal BST to a high level in the normal operation mode in which the serial image data SDATA is continuously supplied to the liquid crystal driving circuit 220 to display an image on the liquid crystal panel 210. Thus, the control unit 120 sets the load change response capability of the first regulator 10 (FIG. 1), the second regulator 30*a*, and the third regulator 30*b* to the first level, which is sufficient for displaying a video on the liquid crystal panel 210. At this time, the power supply current supplied to the liquid crystal driving circuit 220 is 1 mA at the maximum, for example.

On the other hand, the control unit 120 inactivates the selection signal BST to a low level in the low power consumption mode in which a supply of the serial image data SDATA to the liquid crystal driving circuit 220 is stopped and a state is maintained where a fixed image is displayed on the liquid crystal panel 210. Thus, the control unit 120 sets the driving capability of the first regulator 10 (FIG. 1), the second regulator 30*a*, and the third regulator 30*b* to the second level, which is lower than the first level.

As a result, in the low power consumption mode in which power consumption in the liquid crystal driving circuit 220 is small, power consumption in the first regulator 10 (FIG. 1), the second regulator 30*a*, and the third regulator 30*b* can be reduced. At this time, the power supply current supplied to the liquid crystal driving circuit 220 is about 2 μA, for example. The operation current of the power supply unit 110 is 1 μA, for example.

The above embodiment has described the case of supplying a power supply voltage to a liquid crystal driving circuit that drives a liquid crystal panel. However, the invention is also applicable to the case of supplying a power supply voltage to various other circuits. Thus, the invention is not limited to the above-described embodiment, and may be modified in various manners within the technical idea of the invention by a person with common knowledge in the relevant technical field.

What is claimed is:

1. A semiconductor device comprising:

a first regulator that stabilizes an input voltage to generate a stabilized voltage;

a voltage boosting circuit that boosts the stabilized voltage to generate a boosted voltage;

a second regulator that stabilizes the boosted voltage to generate a first power supply voltage; and a third regulator that is connected to the second regulator in parallel, and that stabilizes the boosted voltage to generate a second power supply voltage.

2. The semiconductor device according to claim 1, wherein the voltage boosting circuit includes an N-channel transistor and five P-channel transistors that are connected in series, and boosts the stabilized voltage substantially three times through a charge-pump operation to generate the boosted voltage when a plurality of capacitors are connected to six terminals that are connected, in one-to-one correspondence, to the N-channel transistor and the fixe P-channel transistors.

3. The semiconductor device according to claim 1, wherein the first regulator includes a differential amplifier circuit that operates upon receiving a supply of the input voltage, and amplifies a difference between a reference voltage and a feedback voltage to generate the stabilized voltage, a voltage divider circuit that divides the stabilized voltage to generate the feedback voltage, and a capability selection circuit that selects a load change response capability of the first regulator by changing a value of a bias current flowing through two transistors that constitute a differential pair in the differential amplifier circuit.

4. The semiconductor device according to claim 1, wherein the second or third regulator includes a differential amplifier circuit that operates upon receiving a supply of the boosted voltage, and amplifies a difference between a reference voltage and a feedback voltage to generate the first or second power supply voltage, a voltage divider circuit that divides the first or second power supply voltage to generate the feedback voltage, and a capability selection circuit that selects a load change response capability of the second or third regulator by changing a value of a bias current flowing through two transistors that constitute a differential pair in the differential amplifier circuit.

5. The semiconductor device according to claim 1, wherein the second or third regulator includes a differential amplifier circuit that operates upon receiving a supply of the boosted voltage, and amplifies a difference between a reference voltage and a feedback voltage to generate the first or second power supply voltage, a voltage divider circuit that divides the first or second power supply voltage to generate the feedback voltage, and a voltage adjusting circuit that adjusts the first or second power supply voltage by selecting a voltage division ratio for the voltage divider circuit.

6. The semiconductor device according to claim 1, wherein the first regulator can be set to one of a first state of generating a first voltage as the stabilized voltage and a second state of generating a second voltage that is higher than the first voltage as the stabilized voltage, and the voltage boosting circuit can be set to one of a first state of boosting the stabilized voltage substantially three times and a second state of boosting the stabilized voltage substantially twice.

7. The semiconductor device according to claim 1, further comprising:

a logic circuit that operates upon receiving a supply of the first or second power supply voltage generated by the second or third regulator.

8. A power supply circuit comprising:

the semiconductor device according to claim 1; and a plurality of capacitors connected to the semiconductor device.

9. A liquid crystal display device comprising:

the semiconductor device according to claim 1;

a liquid crystal panel; and a liquid crystal drive circuit that operates upon receiving a supply of the first and second power supply voltages generated by the second and third regulators, and that drives the liquid crystal panel to display an image.

10. The liquid crystal display device according to claim 9, wherein the liquid crystal panel is a memory liquid crystal panel, and the semiconductor device further includes a control unit that sets a load change response capability of the first, second, and third regulators to a first level in a normal operation mode in which image data is continuously supplied to the liquid crystal driving circuit to display an image on the liquid crystal panel, and sets the load change response capability of the first, second, and third regulators to a second level that is lower than the first level in a low power consumption mode in which the supply of the image data to the liquid crystal driving circuit is stopped and a state is maintained where a fixed image is displayed on the liquid crystal display.

11. The semiconductor device according to claim 1, wherein the boosted voltage is supplied to the second and third regulators along a lead line that includes a node connected to both the second and third regulators.

12. The semiconductor device according to claim 1, further comprising:

a reference voltage generation circuit connected to the second regulator and the third regulator such that the second regulator and the third regulator share the reference voltage generation circuit.

* * * * *